US006773011B1

(12) United States Patent
Rom

(10) Patent No.: US 6,773,011 B1
(45) Date of Patent: Aug. 10, 2004

(54) PUZZLE

(75) Inventor: Dror Rom, Huntingdon Valley, PA (US)

(73) Assignee: Prosoft Software, Inc., Wayne, PA (US)

( * ) Notice: Subject to any disclaimer, the term of this patent is extended or adjusted under 35 U.S.C. 154(b) by 0 days.

(21) Appl. No.: 10/400,900

(22) Filed: Mar. 28, 2003

(51) Int. Cl.[7] ..... A63F 9/08
(52) U.S. Cl. ..... 273/153 S
(58) Field of Search ..... 273/157 R, 153 S, 273/155

(56) References Cited

U.S. PATENT DOCUMENTS

| | | | | |
|---|---|---|---|---|
| 4,580,783 A | | 4/1986 | Cohan | |
| 4,978,126 A | | 12/1990 | Morosow et al. | |
| 5,628,512 A | * | 5/1997 | Chan | 273/153 S |
| 6,386,540 B1 | * | 5/2002 | Stevkovski | 273/153 S |

FOREIGN PATENT DOCUMENTS

| | | | | |
|---|---|---|---|---|
| SU | 1472081 | * | 4/1989 | 273/155 |
| SU | 1593674 | * | 9/1990 | 273/155 |
| SU | 1607838 | * | 11/1990 | 273/155 |

* cited by examiner

*Primary Examiner*—Steven Wong
(74) *Attorney, Agent, or Firm*—Design IP

(57) ABSTRACT

A puzzle preferably including a case and a plurality of elements contained therein, each having at least one recess (preferably six) formed thereon. Each of the elements is secured in a fixed position relative to the case and rotatable about at least two, and preferably three, perpendicular axes of rotation. Each of the plurality of elements has a starting position from which the element can be rotated about any one of the axes of rotation. Rotation of each element is limited to one of the axes of rotation when the element is not in the starting position. At least one insert (preferably one less in number than the total number of recesses in the elements) is provided. Each insert includes first and second opposing surfaces that are adapted to be received in any one of the recesses.

20 Claims, 4 Drawing Sheets

PUZZLE

BACKGROUND

The present invention relates to puzzles.

A wide variety of puzzles and puzzle devices are available, including both mechanical and electronic puzzles. In such puzzles, the user manipulates the puzzle to achieve a desired result or to solve a problem. The well-known Rubik's Cube is an example of such a puzzle, wherein the user is required to rotate portions of a cube that are each made up of smaller cubes having differently colored sides. The objective of Rubik's Cube is to manipulate the cube in a matter that results in a desired pattern of colors, the simplest being a single color on each side of the cube.

SUMMARY OF THE INVENTION

The puzzle of the present invention preferably includes a case having an exterior and an interior. A plurality of elements are provided, each having at least one recess formed thereon preferably six recesses). Each of the elements is secured in a fixed position relative to the case and rotatable about at least two, and preferably three, perpendicular axes of rotation. Each of the plurality of elements has a starting position from which the element can be rotated about any one of the axes of rotation. However, rotation of each element is limited to one of the axes or rotation when the element is not in the starting position.

At least one insert is provided (preferably one less in number than the total number of recesses in the elements). Each insert includes first and second opposing surfaces that are preferably identical. The recesses of the elements are preferably shaped to receive at least a portion of each of the first and second surfaces.

BRIEF DESCRIPTION OF THE DRAWINGS

The following detailed description of the preferred embodiments of the invention will be better understood when read in conjunction with the appended drawings. For the purposes of illustrating the invention, there is shown in the drawings embodiments which are presently preferred. It is understood, however, the invention is not limited to the precise arrangements and instrumentalities shown in the drawings.

DETAILED DESCRIPTION OF THE PREFERRED EMBODIMENT

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. It being understood that various changes may be made in the function and arrangement of elements without departing from the spirit and scope of the invention, as set forth in the appended claims.

Where appropriate, the reference number that refers to a feature described in this specification in association with a drawing figure may also be shown in other figures without additional comment in the specification in order to provide context to other features and to provide a better understanding of the invention.

Figure 1:
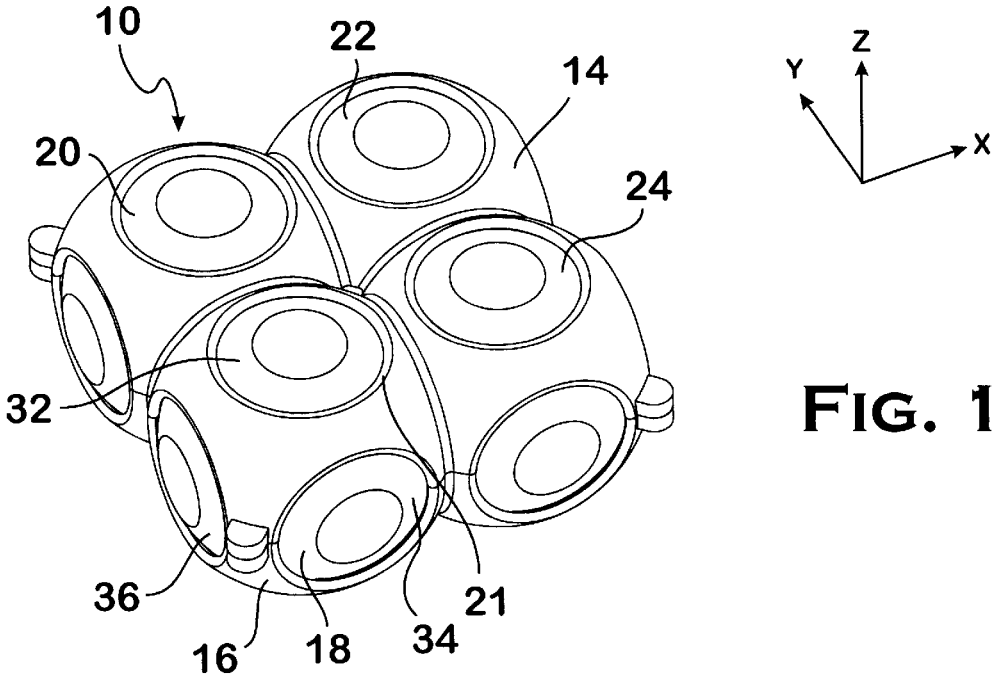
FIG. 1 is a perspective view of a preferred embodiment of a puzzle according to the present invention.
Figure 2:
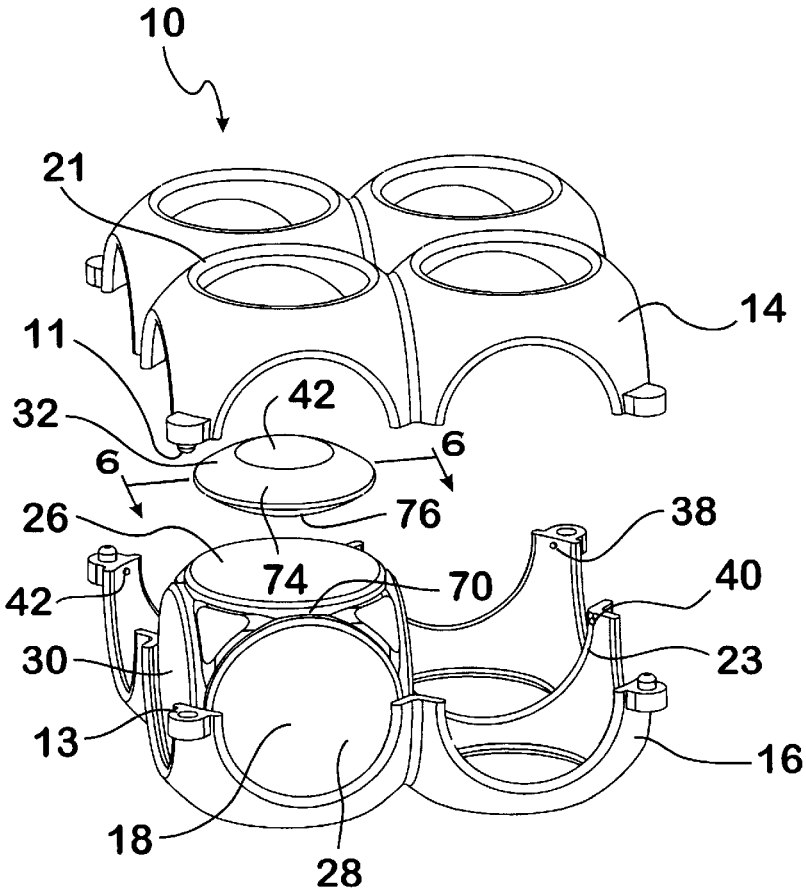
FIG. 2 is an exploded perspective view of the puzzle device shown in FIG. 1.

Referring to FIGS. 1 and 2, reference numeral 10 generally relates to the puzzle of the present invention. The puzzle 10 comprises a case 12 having upper and lower portions 14, 16 that contain elements 18, 20, 22, 24 therein. In this embodiment, four elements 18, 20, 22, 24 are provided in a square planar array. Other configurations are possible, such as larger single-plane arrays or multi-planar arrays, for example.

The upper and lower portions 14, 16 of the case 12 can be assembled using any suitable means. In this embodiment, the upper and lower portions 14, 16 are snapped together using paired nubs and recesses (e.g., nub 11 and recess 13 in FIG. 2). Optionally, the upper and lower portions 14, 15 can be disassembled for cleaning and/or repair.

Each of the four elements 18, 20, 22, 24 is contained within a respective cavity formed by the upper and lower portions 14, 16 when assembled. Each cavity is preferably generally spherical in shape to allow smooth rotation of each element. Each of the elements 18, 20, 22, 24 has six recesses located on opposing orthogonal faces (i.e., three opposing pairs), the recesses being arranged like a six-sided die. Three recesses, a top recess 26, a front recess 28, and a side recess 30, are visible on the element 18 in FIG. 2. All six recesses of each element are preferably identical in shape. In this embodiment, the recesses are an inverted dome shape (see FIG. 4).

The puzzle 10 also includes a plurality of inserts that are designed to move with the elements 18, 20, 22, 24 when rotated and be passed from element to element. The inserts are preferably of different colors, so that different color arrangements are created as the elements 18, 20, 22, 24 are rotated and the inserts are passed from element to element. In this embodiment, the number of inserts is one less than the total number of recesses, which allows one insert at a time to be passed from one element to another (the passing of a element will be described in greater detail herein). Three inserts 32, 34, 36 are shown in FIG. 1. In FIG. 1, these three inserts 32, 34, 36 rest in three respective recesses 26, 28, 30 (see FIG. 2) of element 18. When six inserts are located in respective recesses of an element, the element and the inserts form a generally spherical outer surface. The objective of the puzzle 10 is to manipulate the elements 18, 20, 22, 24 so that the colored inserts are arranged in a desired pattern, such as a single color on each side of the case 12.

The case 12, elements 18, 20, 22, 24 and inserts are all preferably make from a polymer, such a polycarbonate, for example. However, any durable rigid material could be used.

In this embodiment, the case 12 includes a plurality of openings that are located an oriented to compliment that orientation and location of recesses of the spheres 18, 20, 22, 24. Two types of openings are provided: internal openings and external openings.

One of the external openings is identified by reference numeral 21 in FIGS. 1 and 2. The purpose of each external opening is to allow the user of the puzzle 10 to see the inserts and to provide access to the inserts so that the user can rotate the elements 18, 20, 22, 24. Each external opening is preferably circular in shape and has a diameter smaller than that of the inserts in order to prevent the inserts from falling out of the case 12.

The lower portion of one the internal openings is identified by reference numeral 23 in FIG. 2. An internal opening is located between each adjacent sphere. For example, the internal opening 23 identified in FIG. 2 is located between sphere 22 and sphere 24. Thus, in this embodiment there is a total of four internal openings. The purpose of each internal opening is to allow passing of an insert from the recess of one sphere to that of another sphere. The "passing" process will be described in greater detail herein.

The puzzle 10 preferably includes means for restricting rotation of each of the elements 18, 20, 22, 24 to three axes of rotation, X, Y and Z (see FIG. 1). When one of the elements 18, 20, 22, 24 is being rotated about one of the axes of rotation (axis X for example), such means are also preferably adapted to prevent rotation of the element about another of the axes of rotation (axes Y or Z for example) until the element has returned to a position in which the inserts being rotated are centered in a respective external opening (see e.g., the position of insert 32 in external opening 21 in FIG. 1). In this embodiment, the means comprises a groove that encircles each recess of each element 18, 20, 22, 24 and a plurality of guide bosses formed on the interior of the case 12 that fit into the grooves when the puzzle 10 is assembled. The structure and arrangement of the grooves and guide bosses are described in greater detail below.

In the interest of simplicity, one element 18 and one insert 32 will be now be described in greater detail. It is understood that the other elements 20, 22, 24 are identical to the element 18 described in detail herein and that the other inserts are identical to the insert 32 described in detail herein.

Figure 3:
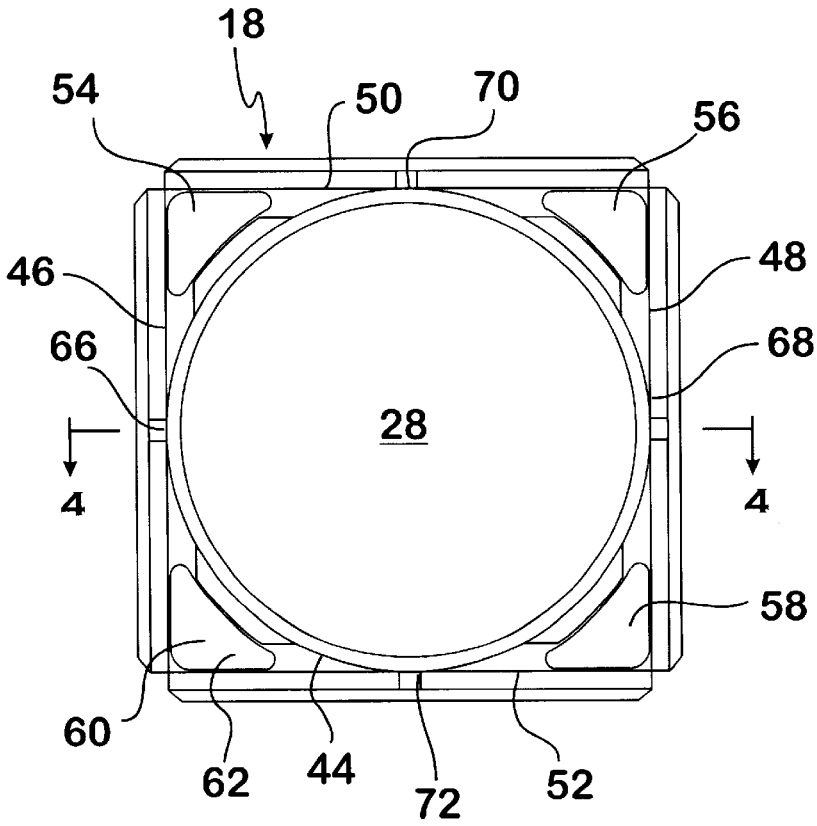
FIG. 3 is an enlarged front view of a sphere shown with the six inserts removed.
Figure 4:
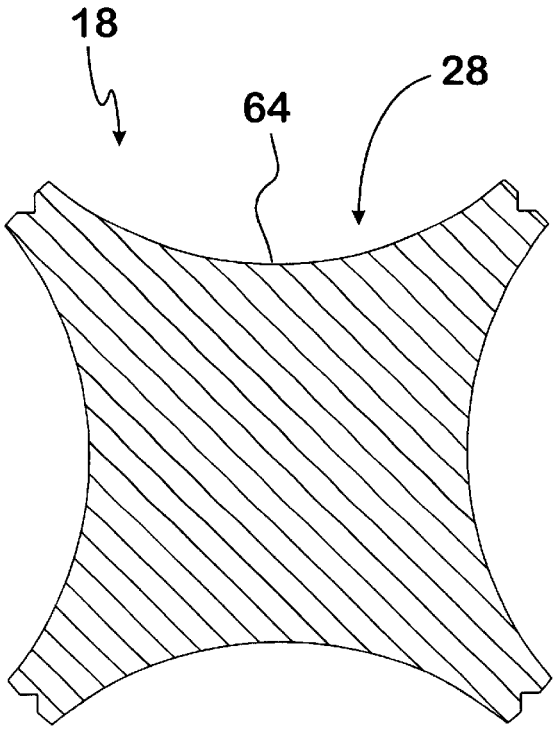
FIG. 4 is a cross-sectional view taken along line 4—4 of FIG. 3.

Referring now to FIG. 3, an enlarged front view of the element 18 is shown with one recess 28 facing forward. As described above, the element 18 includes five other orthogonally-arranged recesses. As described above, the surface of each recess is preferably an inverted dome shape. As an example, the shape of the surface 64 of one recess 28 is shown in FIG. 4.

One of the above-described six grooves 44 is formed around the perimeter of the recess 28. Groove 44 preferably follows a planar path. An identical groove is formed around each of the five other recesses, each preferably following a planar path. The planes of the paths of three of the grooves are preferably parallel to respective planes of one other groove. Portions of four of these grooves 46, 48, 50, 52 are also visible in FIG. 3. Each of the grooves intersects other grooves at four points along its length. For example, the groove 44 that rings recess 28 intersects groove 46 at point 66, groove 48 at point 68, groove 50 at point 70, and groove 52 at point 72.

As described above, the guide bosses (e.g., bosses 38, 40, 42 in FIG. 2) travel along the grooves when the element 18 is rotated and limit rotation to one of the three axes X, Y, Z shown in FIG. 1 at a single time. When an element 18 is oriented so that the inserts located in the recesses of that element 18 are centered in the external openings of the case 12 (hereinafter referred to as a "starting position"), the guide bosses are each located at a respective point of intersection between adjacent grooves (e.g., see points of intersection 66, 68, 70, 72 in FIG. 3).

When in the starting position, rotation of the element 18 can be initiated about any one of the three axes of rotation X, Y, Z. Once rotation begins about one axis, rotation cannot occur about any other axis until the element 18 returns to-a starting position.

A corner guide is preferably provided in each of eight corners of the element 18. The corners are defined as a generally triangular area between adjacent grooves. Four corner guides 54, 56, 58, 60 are visible in FIG. 3. Each corner guide preferably has a surface (for example, the surface 62 of the lower-right corner guide 60 shown in FIG. 3) that follows the contour of the spherical surface formed by the inserts when located in all of the six recesses of the sphere 18. The shape of the surface of each corner guide facilitates smooth rotation of the sphere 18 relative to the case 12.

Figure 5:
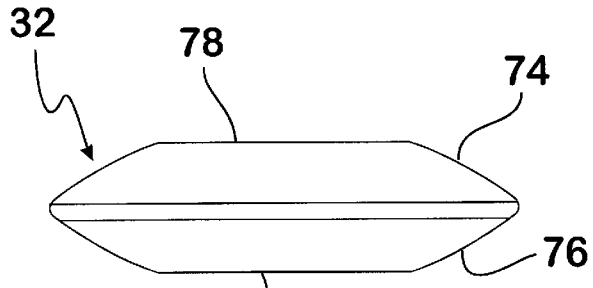
FIG. 5 is an enlarged front view of an insert.
Figure 6:
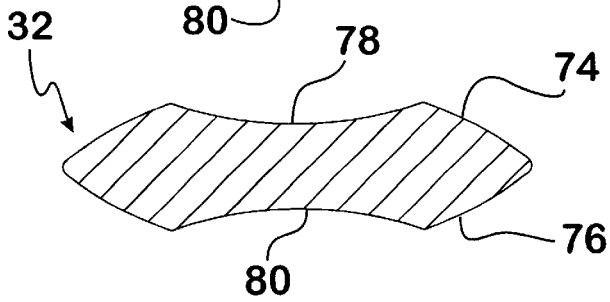
FIG. 6 is a cross-sectional view taken along line 6—6 of FIG. 2.

Referring now to FIGS. 5 and 6, one of the three inserts 32 is shown in greater detail. In this embodiment, the insert 32 is disc-shaped and includes top and bottom surfaces 74, 76 that are preferably symmetrical. This symmetry enables both the top and bottom surfaces 74, 76 to rest in any one of the recess of the elements 18, 20, 22, 24 in either a "top surface in" or "bottom surface in" orientation. The top and bottom surfaces 74, 76 each preferably include a pocket 78, 80, respectively, which provides a recessed area that facilitates rotation of the element 18 when rotational force is applied by the finger of a user of the puzzle 10. The pockets also provide a visual indication of when the insert 32 is centered in an external cavity 21. (see FIG. 1).

Figure 7:
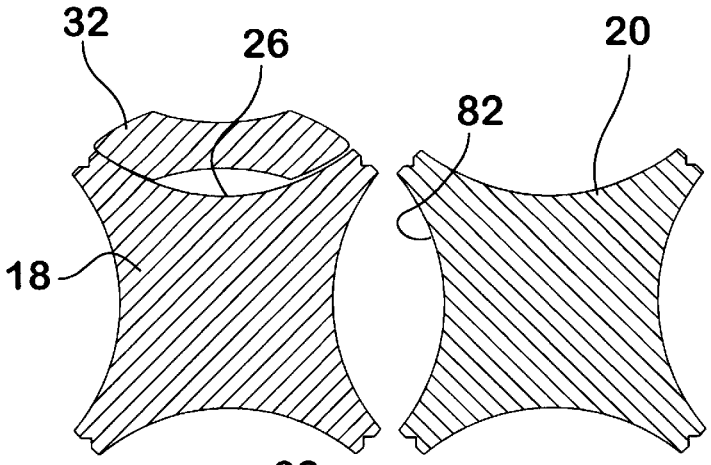
FIGS. 7–11 show five steps in the process of passing an insert from one element to another.
Figure 8:
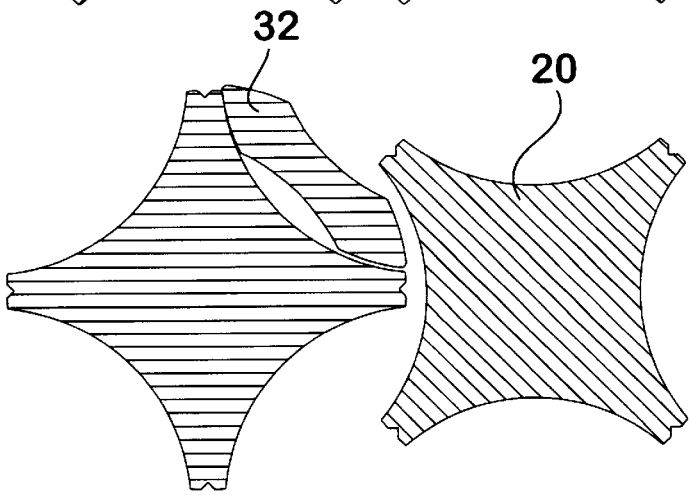
Figure 9:
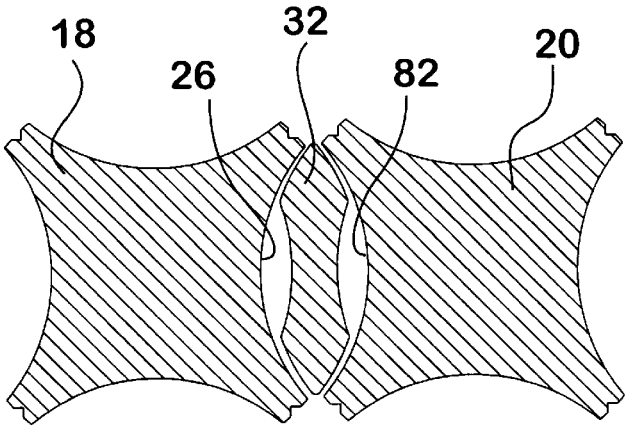
Figure 10:
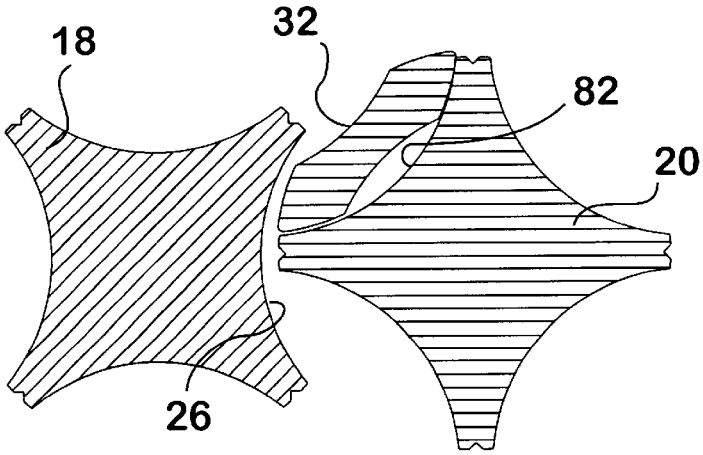
Figure 11:
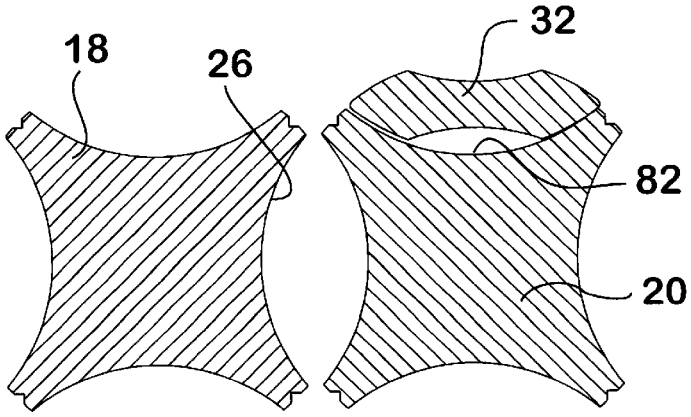

FIGS. 7–11 show five sequential steps of the passing of an insert 32 from the recess 26 of one element 18 to a recess 82 of another element 20. FIG. 7 shows the element 18 in a starting position, in which the insert 32 would be visible through and centered in an external opening of the case 12. FIGS. 8 and 9 show the element being rotated so that the insert 32 is between the recesses 26, 82. FIG. 10 shows the element 20 being rotated with the insert 32 recess 82. FIG. 11 shows the element 20 in a starting position, in which the insert 32 would again be visible through and centered in an external opening of the case 12.

It is recognized by those skilled in the art, that changes may be made to the above-described embodiments of the invention without departing from the broad inventive concept thereof. It is understood, therefore, that this invention is not limited to the particular embodiments disclosed but is intended to cover all modifications which are in the spirit and scope of the invention.

What is claimed is:

1. A puzzle comprising:

a case having an exterior and an interior;

a plurality of elements each of the plurality of elements having at least one recess formed thereon, each of the plurality of elements being in a fixed position relative to the case and rotatable about first and second axes of rotation, the first axis being perpendicular to the second axis, each of the plurality of elements having a starting position from which the element can be rotated about one of the first and second axes of rotation, the element being limited to rotation about only one of the first and second axes of rotation when the element is not in the starting position;

at least one insert having first and second surfaces, the first surface opposing the second surface, and at least one recess being shaped to receive at least a portion of each of the first and second surfaces; and wherein each of the plurality of elements further includes a first groove that extends along a planar path and the case includes at least one guide boss, wherein one of the at least one guide boss travels in the first groove when the element on which the first groove is located rotates about the first axis.

2. The puzzle of claim 1, wherein the interior of the case defines a plurality of cavities formed in the interior of the case, each of the plurality of elements being located in a respective one of the plurality of cavities.

3. The puzzle of claim 2, wherein each of the plurality of cavities is generally spherical in shape.

4. The puzzle of claim 1, wherein each of the plurality of elements is adjacent to at least one other of the plurality of elements and the case includes an internal opening located between each of the plurality of elements an adjacent one of the plurality of elements, the internal opening enabling the at least one insert to be passed from the at least one recess of one of the plurality of elements to the at least one recess of an adjacent one of the plurality of elements.

5. The puzzle of claim 1, wherein each of the plurality of elements further includes a second groove that extends along a second planar path that is perpendicular to the first planar path, wherein one of the at least one guide boss travels in the second groove when the element on which the second groove is located rotates about the second axis.

6. The puzzle of claim 5, wherein each of the plurality of elements is also rotatable about a third axis of rotation, the third axis of rotation being perpendicular to the first axis and the second axis.

7. The puzzle of claim 6, wherein each of the plurality of elements further includes a third groove that extends along a third planar path that is perpendicular to the first planar path and the second planar path, wherein one of the at least one guide boss travels in the third groove when the element on which the third groove is located rotates about the third axis.

8. The puzzle of claim 5, wherein the first and second grooves intersect at a first intersection point, wherein one of the at least one guide boss is located at the first intersection point when the element on which the first and second grooves is located is in the starting position.

9. The puzzle of claim 7, wherein the first and third grooves intersect at a second intersection point, wherein one of the at least one guide boss is located at the second intersection point when the element on which the first and third grooves is located is in the starting position.

10. The puzzle of claim 9, the second and third grooves intersect at a third intersection point, wherein one of the at least one guide boss is located at the third intersection point when the element on which the second and third grooves is located is in the starting position.

11. The puzzle of claim 1, wherein the at least one recess comprises six recesses.

12. The puzzle of claim 10, wherein that at least one recess comprises three pairs of opposing recesses.

13. The puzzle of claim 1, wherein the case comprises at least one external opening through which the at least one insert can be seen from the exterior of the case when the at least one insert is received in the at least one recess of one of the plurality of elements that is in the starting position.

14. The puzzle of claim 1, wherein the at least one insert includes a first pocket located on the first surface and a second finger pocket located on the second surface.

15. The puzzle of claim 1, wherein the at least one insert is one less in number than the total number of the at least one recess on all of the plurality of elements.

16. The puzzle of claim 3, wherein each of the plurality of cavities includes three external openings through which a respective one of the at least one insert can be seen from the exterior of the case when each of the at least one insert is received in a respective one of the at least one recess of one of the plurality of elements that is in the starting position.

17. The puzzle of claim 1, wherein the at least one element comprises four elements, the at least one recess formed on each of the plurality of elements comprises six recesses, and the at least one insert comprises thirty-five inserts.

18. The puzzle of claim 1, wherein the first and second surfaces of the at least one insert are identical.

19. The puzzle of claim 2, wherein the case further includes an upper portion and a lower portion that are assembled to define the plurality of cavities.

20. A puzzle comprising:

a case having an exterior, an interior, and at least one guide boss located on the interior;

a plurality of elements, each of the plurality of elements having six faces, each of the faces being orthogonal to all of the other faces, each of the faces including a recess formed thereon and a groove the encircles one of the recesses; and a plurality of inserts, each of the plurality of inserts having first and second surfaces, the first surface opposing the second surface;

wherein each of the six recesses is shaped to receive at least a portion of each of the first and second surfaces;

wherein each of the plurality of elements is in a fixed position relative to the case is and rotatable about first and second axes of rotation, each of the plurality of elements having a starting position from which the element can be rotated about at least one axis of rotation, each of the at least one guide boss engaging one of the grooves of each element so that rotation of each element is limited to only one of the at least one axis of rotation when the element is not in the starting position; and wherein each of the plurality of elements is adjacent to at least one other of the plurality of elements and the case includes an internal opening located between each of the plurality of elements an adjacent one of the plurality of elements, the internal opening enabling one of the plurality of inserts to be passed from one of the recesses of one of the plurality of elements to one of the recesses of an adjacent one of the plurality of elements.

* * * * *